US006874879B2

(12) United States Patent
Haan et al.

(10) Patent No.: US 6,874,879 B2
(45) Date of Patent: Apr. 5, 2005

(54) INK TANK

(75) Inventors: Maurice Johan Jozef Haan, Landgraaf (NL); Mark Pieter Jozef Pinckaers, Venlo (NL)

(73) Assignee: Oce-Technologies B.V., Ma Venlo (NL)

( * ) Notice: Subject to any disclaimer, the term of this patent is extended or adjusted under 35 U.S.C. 154(b) by 0 days.

(21) Appl. No.: 10/607,165

(22) Filed: Jun. 27, 2003

(65) Prior Publication Data

US 2004/0046845 A1 Mar. 11, 2004

(51) Int. Cl.[7] ..... B41J 2/175
(52) U.S. Cl. ..... 347/86
(58) Field of Search ..... 347/86; 222/105, 222/206, 574, 92; 141/114; 206/484, 521, 592

(56) References Cited

U.S. PATENT DOCUMENTS

| | | | | |
|---|---|---|---|---|
| 4,270,589 A | | 6/1981 | Heinzl | |
| 5,611,461 A | | 3/1997 | Kubota et al. | |
| 5,666,146 A | | 9/1997 | Machizuki et al. | |
| 6,012,807 A | | 1/2000 | Olsen et al. | |
| 6,105,821 A | | 8/2000 | Christine et al. | |
| 6,220,702 B1 | * | 4/2001 | Nakamura et al. | 347/86 |
| 6,264,318 B1 | | 7/2001 | Oda et al. | |
| 6,286,948 B1 | | 9/2001 | Wu et al. | |
| 2001/0040612 A1 | * | 11/2001 | Shimizu | 347/86 |

FOREIGN PATENT DOCUMENTS

| | | |
|---|---|---|
| DE | 198 49 567 A1 | 5/2000 |
| EP | 0 890 441 A2 | 1/1999 |
| EP | 1 013 449 A2 | 6/2000 |
| JP | 60240456 A | 11/1985 |
| JP | 01133749 A | 5/1989 |
| JP | 2000 238291 A | 9/2000 |

* cited by examiner

*Primary Examiner*—Anh T.N. Vo
(74) *Attorney, Agent, or Firm*—Birch, Stewart, Kolasch & Birch, LLP

(57) ABSTRACT

An ink tank for an ink jet printer which includes a casing having a bottom wall and a front wall with an opening provided therein, and a bag disposed in said casing, said bag being collapsible into a sheet-like configuration and having a top wall, a bottom wall, a front edge and a spout provided in a central region of said front edge and located at the position of said front wall opening, wherein the width (W) of the top and bottom walls of the bag, when measured in a flat, sheet-like configuration and in the direction of the front edge, is larger than the width of the casing, and the front wall opening is located near the bottom wall of the casing.

15 Claims, 4 Drawing Sheets

INK TANK

BACKGROUND OF THE INVENTION

This non-provisional application claims priority under 35 U.S.C. § 119(a) on Patent Application No. 02077779.3 filed in Europe on Jun. 28, 2002, which is herein incorporated by reference.

1. Field of the Invention

The present invention relates to an ink tank for an ink jet printer containing a casing having a bottom and a front wall with an opening formed therein, and a bag accommodated in said casing and collapsible into a sheet-like configuration, wherein the bag has a top wall and a bottom wall, a front edge and a spout formed in a central region of said front edge and located at the position of said front wall opening.

2. Background Art

Several ink jet printers are known to include an ink tank that has a comparatively large volume and is arranged stationarily in the frame of the printer and is connected to a movable ink jet device through a flexible tube. In operation, the ink supply to the ink jet device is achieved either by drawing ink out of the tank or by supplying air to the space inside of the casing but outside of the bag, so that as the bag is collapsed the ink is squeezed out. The supply of ink from the tank to the ink jet device may be assisted by gravitational forces. As an alternative, ink supply might be achieved through gravitational forces alone, provided that the casing can be vented. In any case, the bag prevents the ink from leaking out of the casing and/or from being dried out through contact with the air in the casing.

U.S. Pat. No. 6,264,318 discloses an ink tank of the type indicated above, wherein the bag is disposed in the casing in an upright position so that the front edge of the bag extends vertically. As a consequence, the spout and the corresponding opening in the front wall of the casing must be arranged above the bottom of the casing in a position corresponding to approximately one-half of the height of the casing. This has the drawback that, when the ink is consumed and the bag is gradually emptied, the ink tends to collect in the bottom portion of the bag, below the height of the spout, whereby it becomes difficult to empty the bag completely, without any residues of ink remaining in the bag.

U.S. Pat. No. 6,105,821 discloses a tank in which the spout is formed near a corner of the bag, so that it may be disposed near the bottom of the casing. However, this type of bag is more difficult to manufacture because it is not easy to fix the spout in the seal between the walls of the bag and to seal a fluid-tight manner when the spout is arranged near the corner of the bag. Moreover, since the walls of the bag will be stiffened due to the presence of the spout, it is likely that a pocket will be formed where remnants of the ink may collect, even when the spout is positioned near the bottom edge of the bag. In addition, since the top regions of the bag are relatively far away from the spout, there is the risk that, when the bag collapses, a central portion of the bag is squeezed, so that remnants of ink remain enclosed in the top region. This is why this document proposes the use of a rigid flow inductor fitment disposed inside of the bag.

EP-A-1 013 449 discloses a tank in which the bag is disposed horizontally in a flat casing, so that a major portion of the ink may readily flow out even when the spout is arranged in a central region of the front edge of the bag. On this case, however, the casing must have a relatively large width so as to accommodate the bag. This is particularly disadvantageous when a plurality of ink tanks for different colours are to be disposed side-by-side, in order to be on the same level.

SUMMARY OF THE INVENTION

Accordingly, it is an object of the present invention to provide an ink tank that has a compact configuration, is easy to manufacture and permits the ink to flow out smoothly and completely.

Another object of the invention is to provide a method for filling such an ink tank with liquid ink.

In the ink tank according to the present invention, the width of the top and bottom walls of the bag, when measured in a flat, sheet-like configuration and in the direction of the front edge, is larger than the width of the casing, and the front wall opening is located near the bottom of the casing.

Since the width of the bag in its collapsed state is larger than the width of the casing, the bag can only be accommodated in the casing in a bent configuration, with at least one lateral portion of the bag being bent upwardly and supported at a side wall of the casing. As a result, the casing may have a comparatively small width, and the spout will be disposed in the lowest part of the bag and the casing, even when the spout is arranged in the central region of the front edge of the bag.

When the bag is filled with ink, the bottom wall of the bag is supported by the bottom of the casing, and, accordingly, it is only the top wall of the bag that is displaced upwardly away from the bottom wall, whereby the bag is expanded or inflated into an approximately cylindrical shape. When the printer is operating and the ink is gradually consumed, the decreasing ink volume in the bag will allow the top wall of the bag to descend and to become flattened, and, finally, the top wall will once again match the upwardly concave shape of the bottom wall. Since at least one but preferably both lateral zones of the bottom wall of the bag remain bent upwardly because they are supported by the side walls of the casing, the liquid ink will smoothly flow towards the center line of the bag and into the spout under the effect of its own weight.

Since the possible deformations of the bag are constrained, on the one hand by the side walls of the casing, and on the other hand, by the position of the spout and the front wall opening of the casing, the bag is forced to essentially re-attain its original, collapsed state, when it is empty. As a result, it is possible to refill the ink tank repeatedly, by simply introducing ink through the spout, without any need for obtaining access to the interior of the casing.

Preferably, the top and bottom walls of the bag are interconnected at the front edge by an inwardly projecting fold the lower flap of which is sealed to the bottom wall, and the spout is incorporated in the seal between the bottom wall and this lower flap. The fold facilitates an upward displacement of the top wall of the bag, and the spout can remain in its position near the bottom of the casing while the bag is inflated to a relatively large volume. Preferably, a similar fold is also provided at the rear edge of the bag, so that the volume of the bag in the inflated state can be further increased.

In a preferred embodiment, the spout is formed by a rigid member, e.g., one made of plastic, which has a lens-shaped external contour that is sandwiched between the seal portions of the bottom wall and the lower flap of the fold. This configuration facilitates the formation of a fluid-tight seal between the spout and the walls of the bag and has the further advantage that the bottom wall of the bag is forced to match the lens-shaped contour of the spout and is thereby stiffened in a channel-like configuration which permits the ink to flow out smoothly.

The above-described features of the bag are useful even in situations in which the bag is accommodated in a casing having a larger width, so that the lateral portions of the bag need not be bent upwardly.

The material of the bag should, on the one hand, provide a sufficient air and liquid tightness of the bag and, on the other hand, be flexible enough to permit the bag to collapse completely. This can preferably be achieved by a multilayer construction of the walls of the bag, including at least one metal layer and at least one layer made of a synthetic resin. For example, the wall of the bag may be a laminate with an inner layer of aluminum and an outer layer of polyethylene (PE) or polypropylene (PP), respectively.

In a preferred embodiment of the bag, the bottom wall, i.e. the wall forming the outer wall when the bag has a U-shaped configuration, has a greater stiffness than the top wall forming the inner wall of the U-shaped configuration. This has the advantage that the outer wall may smoothly engage the walls of the casing, essentially without forming wrinkles, whereas the greater flexibility of the inner wall permits it to expand and collapse more easily. In the collapsed state, the inner wall will substantially match the smooth surface of the outer wall, so that no substantial pockets will be left within the bag.

In order to assist the bag in collapsing in the desired U-shape configuration, a collapsing induction fitment may be provided at the top wall of the casing for extending into the interior of the casing. Then, when the bag is expanded, its top wall will fit around this fitment, so that the bag retains its U-shaped configuration, even in the expanded state when it almost fills the entire volume of the casing. When the bag collapses, it will reliably retain its U-shaped configuration, which it had already possessed in the expanded state.

In this embodiment, the top edge of the U-shaped bag may reach the upper wall of the casing. As a result, the seals between the top wall and the bottom wall of the bag at the lateral edges thereof may be accommodated in the longitudinally extending top corners of the bag, and in the expanded state, the bag will almost completely fill the volume of the casing. The top wall then has to pass around the fitment and will therefore form an internal fold accommodating the fitment. This internal fold absorbs the excess width of the top wall in relation to the U-shaped bottom wall, so that the top wall may smoothly mate with the fitment without forming warps or wrinkles.

Since the expansion and collapsing behaviour of the bag is controlled by the walls of the casing and, as the case may be, by the collapsing induction fitment, the bag may be filled and emptied multiple times without any need for obtaining access to the interior of the casing, once the bag has been accommodated in the casing. In a preferred embodiment, the casing is therefore composed of two cup-shaped shells which are welded together at a seam surrounding the bag. As a result, the casing may be manufactured easily and at low costs, for example, by injection molding the two shells and then welding them together after the bag has been inserted therein.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
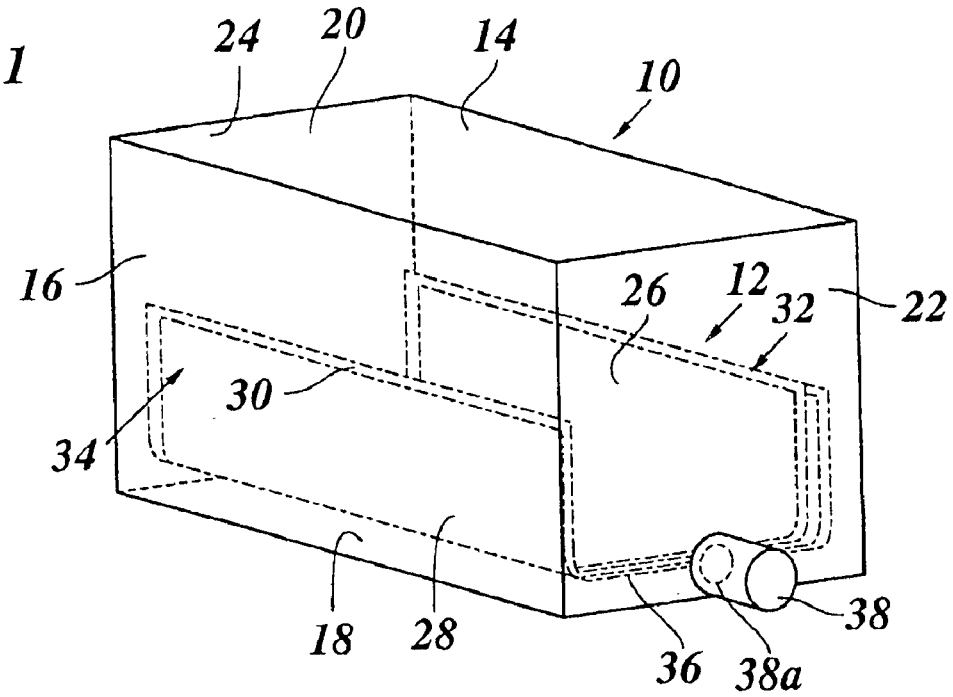
FIG. 1 is a schematic, perspective view of an ink tank according to the present invention in an empty state.

The ink tank shown in FIG. 1 comprises a casing 10 made of plastic, for example, and a bag 12 accommodated in the casing 10.

In the shown embodiment, the casing 10 has essentially the shape of a parallelepiped, comprising side walls 14, 16, a bottom wall 18, a top wall 20, a front wall 22 and a rear wall 24. The bag 12 has a top wall 26 and a bottom wall 28 formed by flexible laminated sheets that are joined together, e.g. by welded seals 30, along their peripheral edge. In FIG. 1 the bag is collapsed into a sheet-like state and is accommodated in the casing 10 in a U-shaped configuration, with side portions 32, 34 of the bag being bent upwardly and supported at the side walls 14, 16 of the casing. A front edge 36 of the bag 12 is fluid-tightly connected to a spout 38 which penetrates an opening 38*a* in the front wall 22 of the casing 10. The spout 38 is arranged in a central region of the front edge 36 of the bag. Since the central portion of the bag lies on the bottom wall 18 of the casing 10, the spout 38 penetrates the front wall 22 of the casing in a position close to the bottom wall 18.

The width of the bag 12, e.g. the width of the top and bottom walls 26, 28 as measured along the front edge 36, is larger than the width of the casing 10 and corresponds approximately to the sum of the width and the height of the casing 10. As a result, the upwardly bent side portions 32, 34 of the bag 12 reach up to a level which corresponds approximately to one-half the height of the casing 10.

Figure 2:
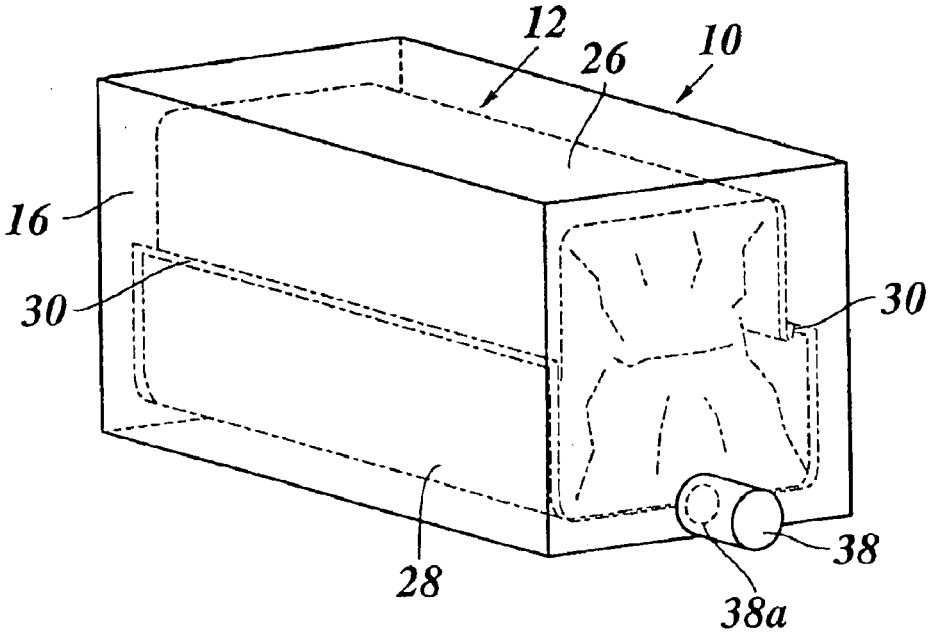
FIG. 2 is a perspective view of the ink tank in the completely filled state.

When liquid ink is introduced into the bag 12 through the spout 38, the bag 12 is inflated or expanded into an approximately cylindrical or box-like configuration, as is shown in FIG. 2. This is mainly achieved by an upward displacement of the top wall 26 which then assumes an upwardly convex shape. As a result, the bag 12 almost completely fills the interior of the casing 10. Only the seal portions 30, where the top wall 26 and the bottom wall 28 of the bag are joined together, are retained in an upwardly bent configuration, because they are pressed against the side walls 14, 16 by the pressure of the liquid inside the bag.

It will be understood that the casing 10 is vented, so that air may escape from the interior of the casing when the bag 12 is inflated. Conversely, when, in FIG. 2, ink is drained through the spout 38, the bag 12 will collapse again and air will enter into the volume inside of the casing 10 that is no longer occupied by the bag. When the bag 12 collapses, the top wall 26 moves downwardly and again attains an upwardly concave shape to finally match the U-shape of the bottom wall 28 once again, when the bag is emptied completely. Since the spout 38 is arranged in the lowest possible position near the bottom of the casing, the ink contained in the bag 12 is allowed to flow out smoothly under its own weight, and when the bag 12 collapses completely, no pockets filled with ink will remain inside of the bag.

Figure 3:
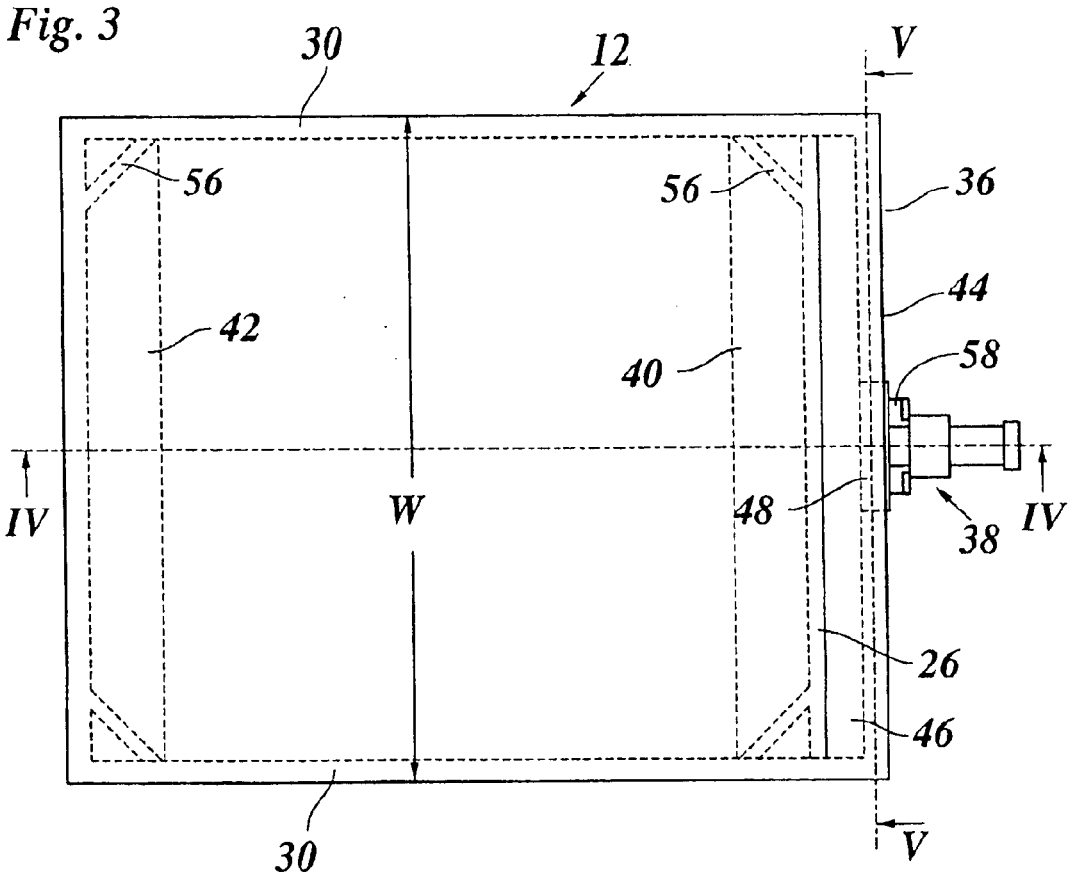
FIG. 3 is a plan view of a bag to be accommodated in the ink tank.

FIG. 3 shows the bag 12 in the collapsed state and in a flat configuration in which the side portions of the top and bottom walls lie in the same plane as the central portions. In FIG. 3, the dimension W indicates the width of the bag 12 which is larger than the width of the casing 10.

Figure 4:
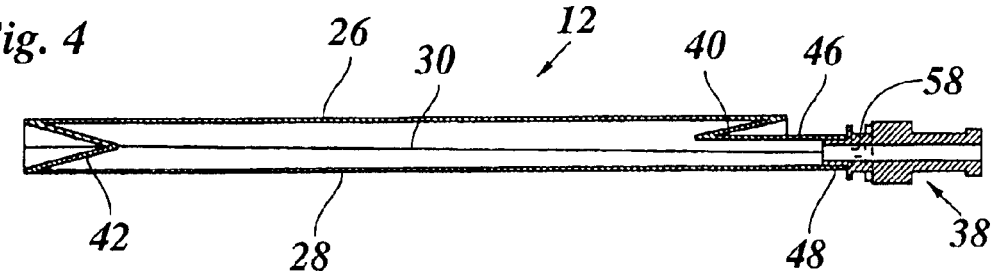
FIG. 4 is a sectional view taken along line IV—IV in FIG. 3.

At the front edge 36 of the bag 12, the front edge of the top wall 26 is slightly offset from the front edge of the bottom wall, and the front and bottom walls are interconnected by an inwardly projecting fold 40, as can best be seen in FIG. 4. A similar fold 42 is formed at the rear edge of the bag. These folds 40, 42 permit the top wall 26 to be displaced upwardly relative to the bottom wall 28 over a large distance, so as to achieve a large volume of the bag.

It will be appreciated that the spout 38 is integrated in a seal 44 (FIG. 3) between the bottom wall 28 and a bottom flap 46 of the fold 40. Thus, the spout 38 is allowed to always retain its position near the bottom of the casing.

Figure 5:
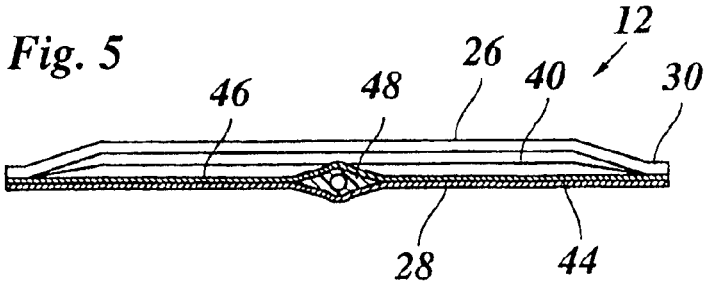
FIG. 5 is a sectional view taken along line V—V in FIG. 3.

As is shown in FIG. 5, the spout 38 has a lens-shaped retaining piece 48 which is smoothly fitted between the flap 46 and the bottom wall 28. This permits the formation of a fluid-tight seal between the spout 38 and the walls of the bag 12.

Figure 6:
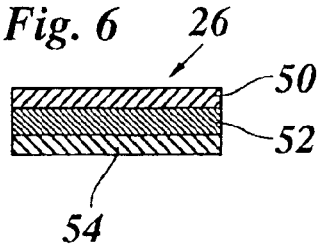
FIG. 6 is an enlarged cross section of a portion of the wall of the bag.

As is shown in FIG. 6, the walls of the bag 12, such as the top wall 26 for example, may comprise an outer layer 50 of polypropylene, an intermediate layer 52 of aluminum and an inner layer 54 of polyethylene. This laminated structure assures a high flexibility and, at the same time a high air and fluid tightness of the bag. The inner layers 54 of polyethylene permit the formation of seals 38, 44 and the like, by welding.

As is shown in FIG. 3, additional diagonal seals 56 are formed in the corners of the bag, in order to prevent ink from being retained in the corner portions. These diagonal seals 56 interconnect the top wall 26 with the top flaps of the folds 40, 42 and will therefore not prevent the top wall 26 from being separated from the bottom wall 28.

In order to hold the bag 12 in position within the casing 10, the spout 38 is formed with grooves 58 which may be engaged by the front wall 22 of the casing.

Figure 7:
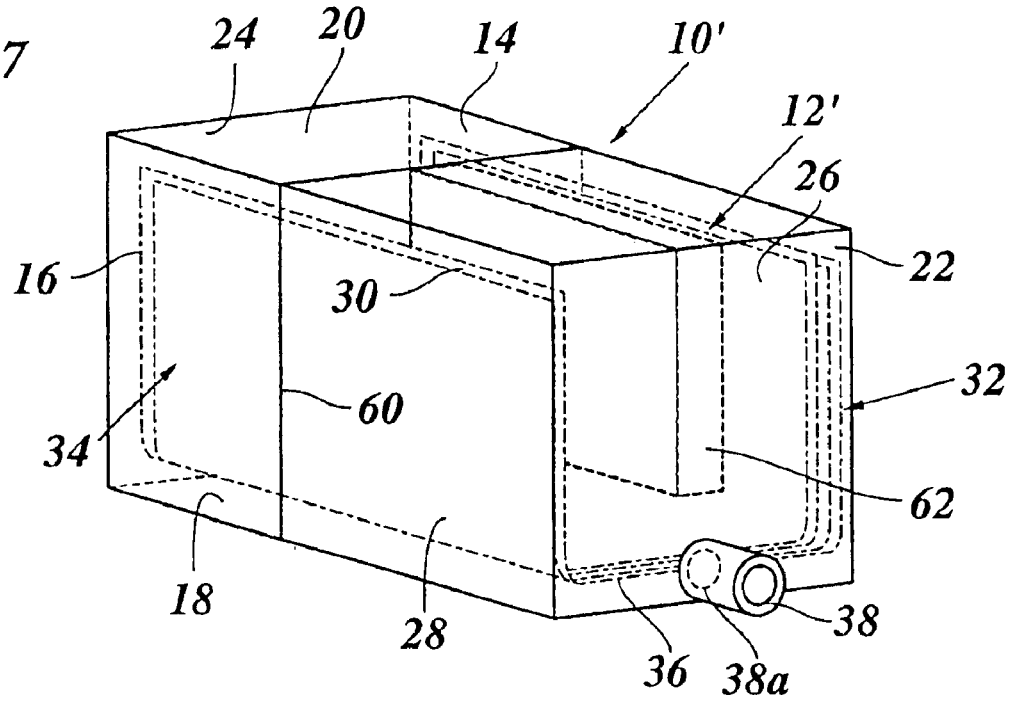
FIGS. 7–9 are views corresponding to FIGS. 1, 2 and 4, showing a modified embodiment of the present invention.

FIG. 7 shows an ink tank according to another embodiment of the present invention, comprising a casing 10' and a bag 12'.

Here, the casing 10' is composed of two injection-molded cup-shaped shells or halves that are welded together at a weld seam 60 which passes through the side walls 14, 16, the bottom wall 18 and the top wall 20 of the casing and thus surrounds the bag 12' accommodated in the casing. In the manufacturing process, the bag 12' is at first inserted into the casing half which forms the opening 38*a*, and the spout 38 is fitted in the spout opening. Then, the second casing half is fitted over the rear end of the bag 12' which projects out of the open rear end of the first half of the casing, and the two casing halves are welded together at the seam 60, e.g. by means of ultrasonic welding. Of course, this manufacturing process may also be applied to the casing 10 shown in FIGS. 1 and 2.

The bag 12' according to the second embodiment of the present invention is different from the bag 12 according to the first embodiment in that the total width W is larger, so that the top edges of the side portions 32, 34 reach up to the top wall 20 of the casing.

When the bag 12' is inflated, the top wall 26 thereof is lifted up to the top wall of the casing and has only to bridge the opposing edges of the side portions 32 and 34. However, since the top wall 26 has essentially the same width as the bottom wall 28 of the bag, the width of the top wall would be too large in this state. In order to prevent the top wall 26 from forming folds in an uncontrollable manner and in order to prevent the bag 12' to collapse in an uncontrollable way when it is emptied, a collapsing induction fitment 62 shaped as a rectangular plate is formed on the internal side of the top wall 20 of the casing 10'. The fitment 62 extends from the widthwise center of the top wall 20 into the interior of the casing to a level shortly above the spout 38, and it extends longitudinally from the front wall 22 of the casing to the position of the weld seam 60. Thus, the fitment 62 is only formed in one of the two casing halves.

Figure 8:
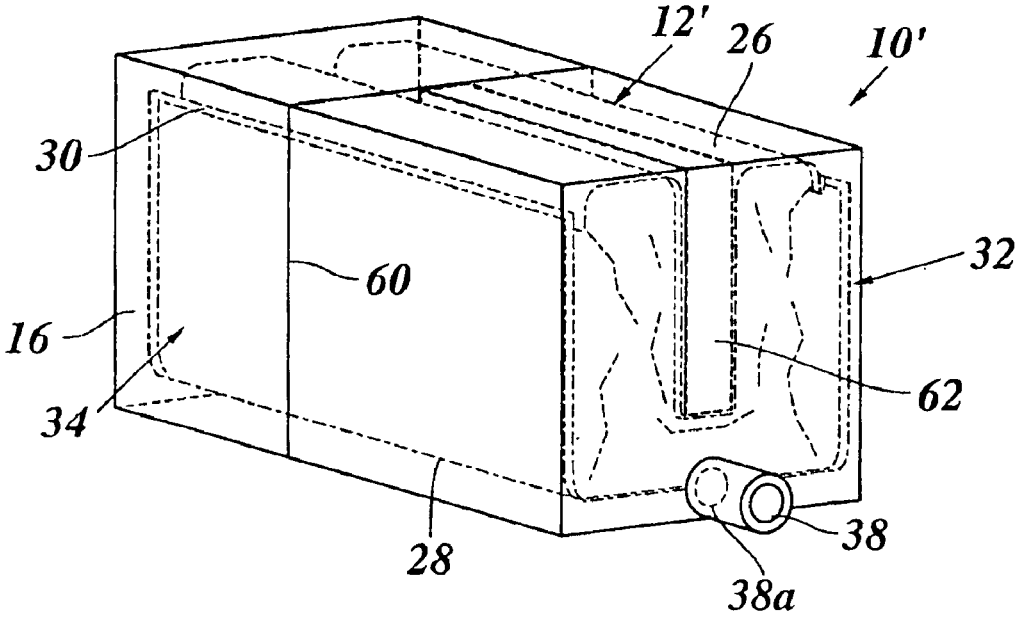

When the bag 12' is inflated, as shown in FIG. 8, it will fit around the fitment 62 and will, as a whole, retain a U-shaped configuration. As a result, the top wall 28 smoothly follows the contour of the fitment 62 and forms in internal fold which absorbs the excessive width. When the bag is collapsed again, the U-shape is preconfigured already, and this will reliably cause the bag to reassume the configuration shown in FIG. 7.

Figure 9:
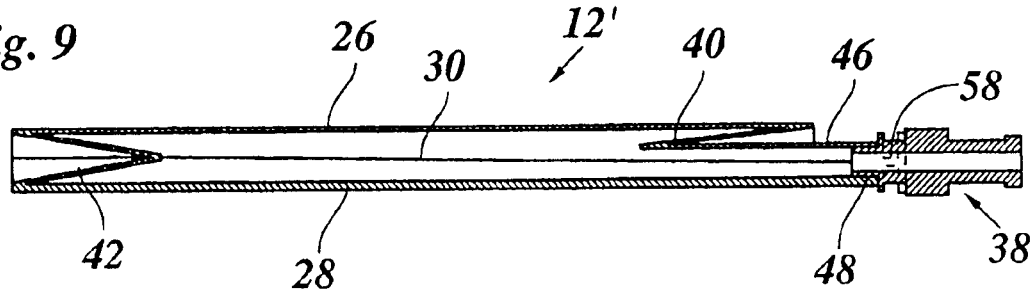

In FIG. 9, it can be seen that the folds 40, 42 of the bag 12' project deeper into the interior of the bag, as compared to FIG. 4. This permits the top wall 36 to be lifted in its entirety, when the bag is inflated, so that the bag may almost completely fill the interior of the casing 10'.

As is further shown in FIG. 9, the bottom wall 28 of the bag 12' is thicker and has a higher rigidity than the more flexible top wall 26. As a result, when the bag is accommodated in the casing 10', the stiffer bottom wall 28 will not warp or wrinkle but will be bent smoothly to engage the bottom wall 18 and the side walls 14, 16 of the casing. The greater flexibility of the top wall 26 permits the same to smoothly mate with the shape of the top wall 20 and the fitment 62 of the casing in the expanded state of the bag and to smoothly mate with the bottom wall 28 of the bag in the collapsed state.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. An ink tank for an ink jet printer, which comprises:

a casing having a bottom wall and a front wall with an opening provided therein, and a bag disposed in said casing, said bag being collapsible into a flat, sheet-like configuration and having a top wall, a bottom wall, a front edge and a spout provided in a central region of said front edge and located at the position of said front wall opening, wherein widths(W) of the top and bottom walls of the bag, when measured in the flat, sheet-like, folded configuration and in the direction of the front edge, is larger than the width of the casing, and the front wall opening is located near the bottom wall of the casing.

2. The ink tank according to claim 1, wherein the spout is fixedly held in the opening of the front wall of the casing.

3. The ink tank according to claim 1, wherein the top wall and the bottom wall of the bag are interconnected by an inwardly projecting fold at the front edge of the bag, and the spout is incorporated in a seal provided between the bottom wall and a lower flap of the fold.

4. The ink tank according to claim 3, wherein another inwardly projecting fold interconnects the top wall and the bottom wall at a rear edge of the bag.

5. The ink tank according to claim 3, wherein the top wall and the bottom wail of the bag are directly interconnected by seals extending along lateral edges of the bag.

6. The ink tank according to claim 1, wherein the spout has a retaining piece which has a lens-shaped cross section and is inserted between wall portions of the bag, which form a seal.

7. The ink tank according to claim 1, wherein the wall material of the bag has a laminated structure including at least two layers of synthetic resin with a metal layer interposed therebetween.

8. The ink tank according to claim 1, wherein the bottom wall of the bag is stiffer than the top wall.

9. The ink tank according to claim 1, wherein the width of the bag corresponds to the width of the casing plus twice the height of the casing, and the bag is disposed in the casing in a U-shaped configuration with two side portions thereof being bent upwardly into the vicinity of a top wall of the casing.

10. The ink tank according to claim 9, further comprising a collapsible induction fitment extending from the top wall of the casing and into the interior of the casing.

11. The ink tank according to claim 1, wherein the casing is composed of two cup-shaped shells welded together at a weld seam which surrounds the bag disposed in the casing.

12. The casing of claim 1, wherein the width of the bag, in its collapsed state, extends along the contour of the side walls of the casing up to the vicinity of a top wall of the casing, and a collapsing induction fitment extended from the top wall of the casing into the enclosure to a level above the spout whereby internal folds formed in the bag as it collapses, as a result of the excessive width of the bag are effectively accommodated.

13. The casing of claim 12, wherein the induction fitment extends from the top wall in a rectangular configuration.

14. A method of filling an ink tank with ink which comprises a step of introducing ink through a spout into a bag disposed in a casing in a flat, sheet-like, collapsed and bent state in which at least one side portion of the bag is bent upwardly and supported at a side wall of the casing, whereby, by introducing the ink, the top wall of the bag is displaced upwardly away from the bottom wall.

15. A casing defining an enclosure and comprising an opening provided in a front wall thereof, a collapsible bag member disposed in said enclosure, said bag member having a width dimension larger than that of the enclosure such that in its collapsed state it folds on itself to form a flat, sheet-like configuration having a top wall, a bottom wall, a front edge and a spout provided in a central region of said front edge and located at the position of said front wall opening, said bag, in its collapsed state extending along the contour of the side walls of the casing in a self-supporting manner.

* * * * *